US007063318B2

(12) United States Patent
Jacobs et al.

(10) Patent No.: US 7,063,318 B2
(45) Date of Patent: Jun. 20, 2006

(54) SHEET DESKEW SYSTEM AND METHOD

(75) Inventors: Jos W. Jacobs, Tigard, OR (US); Thomas R. Edney, Wilsonville, OR (US); Nathan E. Hult, Wilsonville, OR (US)

(73) Assignee: Xerox Corporation, Stamford, CT (US)

( * ) Notice: Subject to any disclaimer, the term of this patent is extended or adjusted under 35 U.S.C. 154(b) by 154 days.

(21) Appl. No.: 10/740,490

(22) Filed: Dec. 22, 2003

(65) Prior Publication Data

US 2005/0133988 A1 Jun. 23, 2005

(51) Int. Cl.

| | |
|---|---|
| ***B65H 1/08*** | (2006.01) |
| ***B65H 31/20*** | (2006.01) |
| ***G07F 11/16*** | (2006.01) |

(52) U.S. Cl. ..... 271/226; 271/242

(58) Field of Classification Search ..... 271/226, 271/242, 9.01, 9.13, 227
See application file for complete search history.

(56) References Cited

U.S. PATENT DOCUMENTS

| | | | | |
|---|---|---|---|---|
| 4,436,404 | A * | 3/1984 | Simmons et al. | 399/401 |
| 5,333,728 | A * | 8/1994 | O'Brien et al. | 206/232 |
| 5,543,909 | A * | 8/1996 | Quesnel | 399/394 |
| 5,775,690 | A * | 7/1998 | Quesnel et al. | 271/242 |
| 5,904,350 | A * | 5/1999 | Creighton et al. | 271/227 |
| 5,933,697 | A * | 8/1999 | Onodera et al. | 399/406 |
| 6,120,019 | A * | 9/2000 | Kayser et al. | 271/182 |
| 6,338,481 | B1 * | 1/2002 | Maruchi | 271/188 |
| 6,496,660 | B1 * | 12/2002 | Takahashi et al. | 399/16 |
| 6,554,216 | B1 * | 4/2003 | Escobedo et al. | 242/270 |
| 6,634,634 | B1 * | 10/2003 | Sugimura | 271/9.11 |
| 6,805,347 | B1 * | 10/2004 | Kuramoto | 271/242 |
| 6,834,853 | B1 * | 12/2004 | Trovinger et al. | 271/227 |
| 2003/0049046 | A1 * | 3/2003 | Okabe | |

* cited by examiner

*Primary Examiner*—Kathy Matecki
*Assistant Examiner*—Rakesh Kumar
(74) *Attorney, Agent, or Firm*—Oliff & Berridge, PLC

(57) ABSTRACT

Systems and methods for deskewing a substrate with at least one of a first substrate supplying member and second substrate supplying member that supplies substrates to a chamber that receives the sheet supplied from both the first substrate supplying member and the second substrate supplying member.

10 Claims, 9 Drawing Sheets

SHEET DESKEW SYSTEM AND METHOD

BACKGROUND OF THE INVENTION

1. Field of Invention

The invention relates to systems and methods for deskewing a substrate.

2. Description of Related Art

There are a variety of transport and deskew systems in use that transport and register various substrates, such as copy sheets. In many deskew systems, such as those often found in copiers, facsimiles, and printers (i.e., reproduction systems), drive mechanisms often include at least one driven elastomer-covered roll backed by a hard idler roll to form a roll pair defining a nip region there between. A substrate, such as copy paper, provided to the nip region is advanced by rotation of the roll pair, specifically rotation of the driven roll, which causes corresponding linear movement of the substrate, such as paper.

Paper skew is the angular deviation of the longitudinal axis of the substrate in the process direction and/or the angular deviation of the lateral axis of the substrate perpendicular to the process direction. The lateral edges are the edges of the sheets that are substantially parallel to the process direction. The process edges are edges of the sheets that are substantially perpendicular to the process direction. The process edges may be referred to as the leading edge and the trailing edge.

In order to remove the skew, a leading edge of a sheet, provided at a nip region of a downstream roll pair, is stopped while an upstream roll pair continues to advance the sheet to thereby form a buckle. The buckle ensures that the leading edge straightens out against the nip region of the downstream roll pair. The substrate is then pulled straight through the nip after the buckle has been formed and the skew has been removed.

Conventional reproduction systems typically include three supply paths that are used to supply sheets to a print engine. The supply paths typically include (1) a path that transports sheets from a sheet supply tray that stores a plurality of sheets within the reproduction system, (2) a path that transports sheets from a multi-purpose tray that stores sheets on a tray attached to an outside of the reproduction system and (3) a path that returns printed sheets to the print engine so that double sided printing can be performed.

Typically, there are separate deskew systems for each path in order to correct deskew errors due to paper skew, process edge deskew errors in the process direction and/or lateral edge deskew errors. Each of the deskew systems include a one-sided buckle chamber that is bordered on one side with the deskew nip and on another side with a common transport roller with a sufficient nip load. After a firm grip has been achieved by the common transport roller, a buckle is formed on only one side of the buckle chamber.

Also, in most conventional deskew systems used in various reproduction systems, the types of substrates being transported usually do not vary much. That is, many systems typically encounter only a limited number of different substrate types, such as basic draft sheet stock of a certain weight in basic sizes such as A4 or 8.5×11 inches. A typical deskew system is designed to transport, for example, 20 lb. bond sheet stock (roughly 75 grams/$m^2$ or GSM). Occasionally, higher quality bond paper of a slightly higher weight, such as 24 lb. bond (roughly 90 GSM) or 28 lb. bond (roughly 105 GSM) sheet stock is used. In conventional deskew systems, these sheets are transported using the same drive profiles. That is, the drive control parameters are fixed (i.e., set irregardless of the weight of the sheet being used).

In the United States, paper weight is expressed as pounds per 500 sheet ream of uncut C-size paper (4×letters size). As such, a cut ream of 20 pound letter paper (500 sheets of 8.5×11) would weigh 5 pounds. Because each type of paper has a different "basis size", it is often confusing to talk in terms of the U.S. pound weight system. Instead, it is much more convenient to express paper "weight" as mass per unit area as in the ISO (metric) system in which the weight of paper is given in grams per square meter (GSM). For example, 20 pound bond letter stock corresponds to roughly 75 GSM, 24 pound bond letter stock corresponds to roughly 90 GSM, and 28 pound bond letter stock corresponds to roughly 105 GSM. 20 pound Bristol board on the other hand, which has a different basis size, corresponds to roughly 44 GSM. Other known substrates can have substantially higher GSM, some over 300 GSM.

SUMMARY OF THE INVENTION

While prior printers, copiers and facsimile machines typically encountered only a handful of different types of substrates, such as A4 or 8.5×11" papers in only a small range of paper weights or densities, today there is a trend toward using more and more diverse varieties of substrates in such systems. Deskew systems today thus may be required to accommodate delivery of a wide variety of substrates, each having diverse physical properties.

There is a constant need to reduce the size of reproduction systems. With separate deskew systems for each path, a lot of chamber space is required in order to create the separate buckles. This space is wasted because each deskew system creates a similar buckle without sharing a common deskew chamber. Also, manufacturing costs are increased in providing a structure for each separate deskew chamber.

Furthermore, none of the deskew systems take into account the various properties of various substrates. Thus consideration has not been given to stiff substrates where a buckle is not easily formed. Also, consideration has not been given to sensitive substrates where damage can occur to the surface of the substrate.

Because of this, there is a need for systems and methods that can consolidate the deskew system so that different paths meet at one common chamber.

There also is a need to compensate for the different properties of the substrates so that a sufficient amount of buckle can be created for stiff substrates.

There is also a need to compensate for the different properties of the substrates so that delicate substrates are not damaged when a skew is removed.

The systems and methods of this invention provide sheet deskew that involves a double sided deskew chamber.

The systems and methods of this invention separately provides sheet deskew that involves a double sided deskew chamber that can be bordered by a pick nip, which typically has too little drive force to form a buckle with stiff media.

The systems and methods of this invention separately provide sheet deskew that doubles the space effectiveness of the deskew buckle area and allows for multiple media paths to merge in front of or in the deskew area.

The systems and methods of this invention separately provide sheet deskew that drives a substrate past a receiving roller nip using a supply roller, stops both roller nips and the reverses the receiving rollers.

The systems and methods of this invention separately provide sheet deskew that increases the substrate holding force when using a pick nip, thereby facilitating better buckle formation.

The systems and methods of this invention separately provide sheet deskew that can avoid high substrate friction points.

Exemplary systems of this invention may include a first substrate supplying member that feeds a substrate from a first direction, a second substrate supplying member that feeds the substrate from a second direction, a substrate receiving member that receives the substrate from the first substrate supplying member and the second substrate supplying member, a chamber located downstream from the first substrate supplying member and the second substrate supplying member and upstream from the substrate receiving member, the chamber including a first wall and a second wall opposite the first wall and a controller that controls a drive profile of the first substrate supplying member, the second substrate supplying member and the substrate receiving member. When the substrate is supplied from the first substrate supplying member to the substrate receiving member when the substrate receiving member is stopped, the substrate moves to the first wall of the chamber and when the substrate is supplied from the second substrate supplying member to the substrate receiving member when the substrate receiving member is stopped, the substrate moves to the second wall of the chamber.

Exemplary systems of this invention may also include a first substrate supplying member that feeds a substrate from a first direction, a substrate receiving member that receives the substrate from the first substrate supplying member and a controller that controls a drive profile of the first substrate supply member and the substrate receiving member. The controller selectively drives both the first substrate supplying member and the substrate receiving member in a first direction, drives the first substrate supplying member in the first direction and stops the substrate receiving member, and drives the second substrate receiving member in a second direction opposite the first direction and stops the first substrate supplying member.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described with reference to the following figures, wherein.

DETAILED DESCRIPTION OF EXEMPLARY EMBODIMENTS

Figure 1:
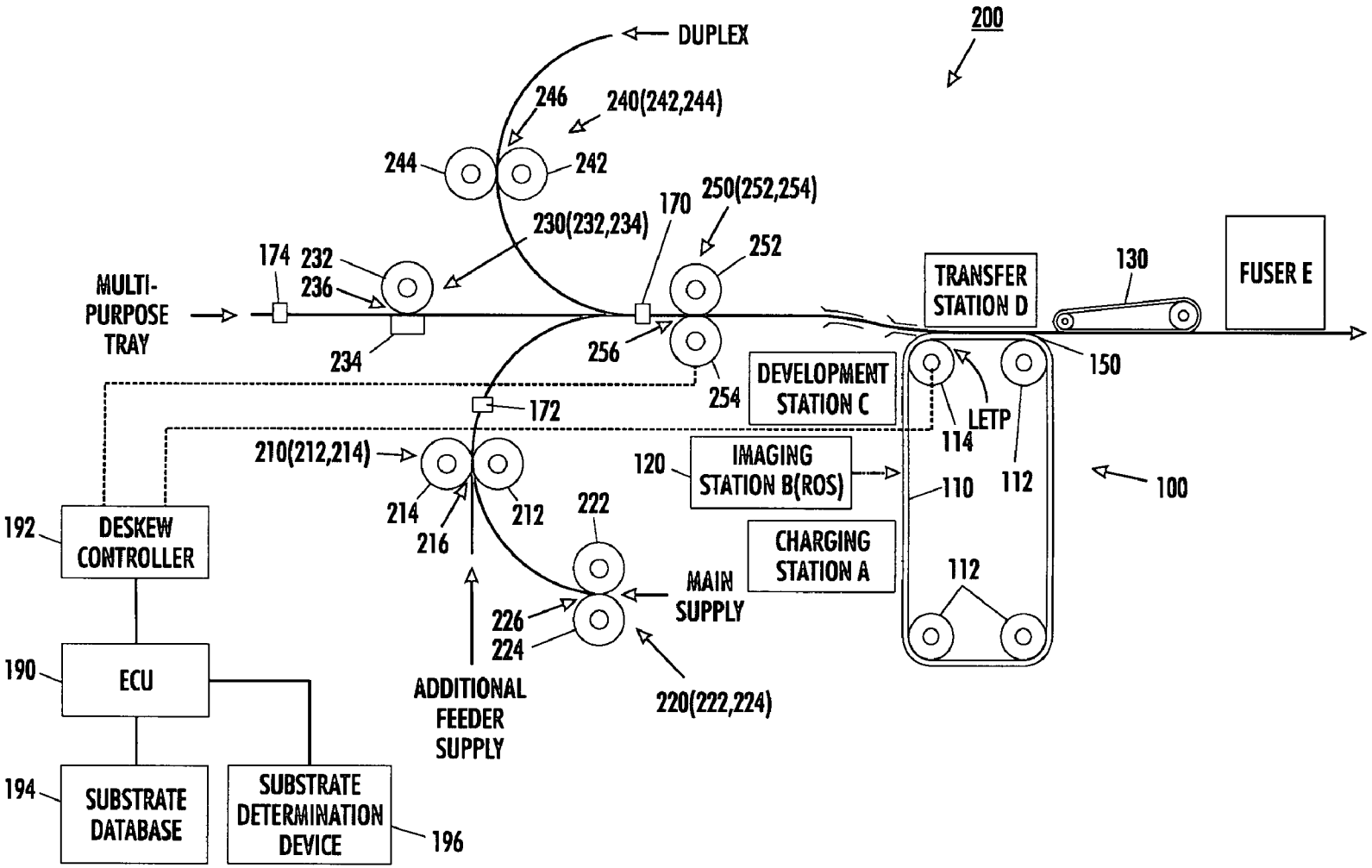
FIG. 1 shows a schematic representation of an exemplary electro photographic machine incorporating a deskew system according to an exemplary embodiment of this invention.

For a general understanding of an electro photographic printer, solid ink printer or copying machine (i.e., reproduction system) in which the features of this invention may be incorporated, reference is made to FIG. 1, which depicts schematically various key components thereof. Although this invention for accurately transporting and deskewing a broad array of substrate types along a predetermined path is particularly well adapted for use in such a machine, it should be apparent that this embodiment is merely illustrative. Rather, aspects of this invention may be achieved in any deskew system in which a broad number of substrate or media types need to be advanced and deskewed in a precise, accurate manner and the drive system includes one or more roller pairs or drive nips whose displacement and velocity performance varies with properties of the substrate or media being driven.

In FIG. 1, an electro photographic printer (copier) 100 employs a conventional photoconductive belt 110 assembly having a photoreceptive surface on which one or more images can be provided. Alternatively, any other conventional or subsequently developed photoreceptive surface may be provided. For example, it is also well known to use a drum having a photoconductive surface instead of the belt.

Belt 110 moves in the direction of the arrow (clockwise) to advance successive portions sequentially through various processing stations disposed about the path of the belt 110. Belt 110 is advanced by way of a series of rollers 112 and at least one driven roller 114 at a predetermined process speed as known in the art. Initially, a portion of the photoconductive surface of belt 110 passes through a charging station A. Here, one or more corona generating devices charge the photoconductive belt 110 to a relatively high uniform potential. Then, the charged portion is advanced through imaging station B.

At imaging station B, an imaging system such as a raster output scanner (ROS) 120 discharges selectively those portions of the charge corresponding to image portions of the document to be printed or reproduced. This records an electrostatic latent image on the photoconductive surface. ROS 120 may be any conventional or subsequently developed scanner, typically including a laser with a rotating polygon mirror block. However, other imaging systems can be employed, for example, an LED write bar or a projection liquid crystal display (LCD) or other electro-optic display.

Thereafter, belt 110 advances the electrostatic latent image recorded thereon to development station C which, for example, could be any conventional or subsequently developed system, such as a magnetic brush development station. At station C, toner particles are attracted to the electrostatic latent image to form a toner powder image on the conductive surface of belt 110. Belt 110 then advances the toner powder image to transfer station D.

At transfer station D, a substrate, such as a copy sheet 150 of paper, is moved into contact with the toner powder image. Then, transfer is achieved through conventional or subsequently developed devices, such as, for example, a corona generating device that charges the copy sheet 150 to a proper magnitude and polarity so that the copy sheet 150 becomes attracted to and in contact with the toner powder image on the surface of belt 110, at which time the powder toner image is attracted from the belt onto the copy sheet 150. After transfer, the corona generating device charges the copy sheet 150 to an opposite polarity to detach the copy sheet from belt 110. Copy sheet 150 is then advanced to fusing station E, such as by pre-fuser transport conveyor 130.

Fusing station E includes a fuser assembly, which can consist of conventional or subsequently developed fuser elements, such as the shown heated fuser roll and a pressure roll as known in the art. After fusing, the copy sheet 150 having a fused image thereon may be advanced to an output tray (not shown) or other post-processing device, such as a binder, finisher, collator or stapler.

Sheet 150 transportation is achieved by operating a third supply member 250, which causes corresponding linear movement of the copy sheet 150 through a nip region. The position, timing and velocity of the sheet 150 is controlled by a deskew controller 192, which receives signals from an electronic control unit (ECU) 190, which is associated with a substrate database 194 and a substrate determination device 196.

Figure 2:
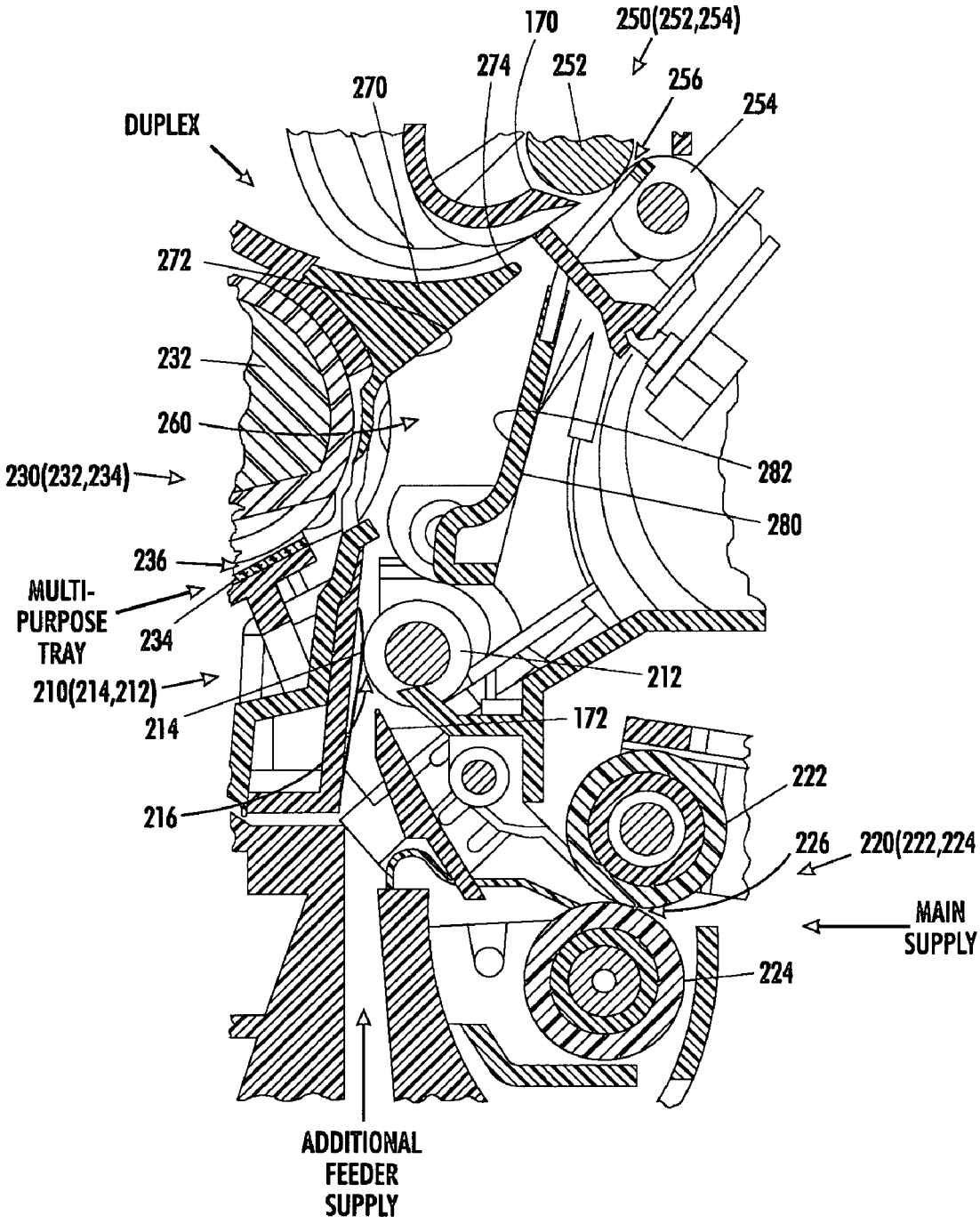
FIG. 2 shows a cross sectional view showing in detail a deskew system according to an exemplary embodiment of this invention.

As shown in FIGS. 1 and 2, a sheet 150 is advanced by the supply member 250 from an upstream supply, such as from a main supply or an additional feeder supply, a duplex path or a multi-purpose tray, by at least one supply member, such as exemplary first supply member 210, second supply member 230 and supply member 240 shown. As should be appreciated with FIG. 1, the sheet 150 is advanced to a leading edge transfer position LETP close to the belt 110. However, the sheet 150 is advanced to a drum of a solid ink printer (or print engine in general) or the sheet can be advanced to any position within the reproduction system by the supply member 250.

Copy sheets 150 are advanced from a sheet supply tray by an upstream feeder to the supply members 210, 220, returns to the transfer station D for double sided printing from a duplex path to the supply member 240 and are advanced from a multi-purpose tray to the supply member 230. Sheets 150 advanced by the supply members 210, 230 are further advanced to a deskew chamber 260 before being sent to the supply member 250. The supply member 250 then advances the sheets 150 to the transfer station D.

As shown in FIGS. 1 and 2, the supply members 210, 220 and 240 consist of a driven roller 212, 222 and 242 backed by an opposing idler roller 214, 224 and pad 244 that define a nip region 216, 226 and 246 there between. While only a single roll pair is shown in the side view, there are sometimes two or more roll pairs at each location, one outboard and one inboard in the widthwise or lateral direction of the sheets 150 (transverse to the process direction). The driven roller 212, 222 and 242 is driven by a drive mechanism, such as a drive motor operably coupled to the roll. Suitable coupling may be through a drive belt, pulley, output shaft, gear or other conventional linkage or coupling mechanism.

Because idler rollers 214, 224 and 244 contact driven rollers 212, 222 and 242, rotation of driven rollers 212, 222 and 242 about a respective shaft in a counterclockwise direction, for example, causes an opposite rotation of idler rollers 214, 224 and 244 about a respective shaft in a clockwise direction. Actual movement of sheets 150 being driven by a drive roller pair or pick nip, such as an elastomer-covered drive roll backed by a hard idler roll is an outcome of a large number of physical properties of both the drive roll nip and the substrate passing through it. Regarding the substrate itself, these properties potentially include substrate thickness, substrate mass per unit volume, substrate bending stiffness, and substrate coefficient of friction to the driven roll.

The supply member 230 supplies sheets stacked on a multi-purpose tray. The supply member 230 consists of a separation pad 234 backed by an opposing driven roller 232 that define a nip region 236 there between. When a sheet 150 stacked on the multi-purpose tray is introduced between the separation pad 234 and the driven roller 232, a single sheet 150 is conveyed to the deskew chamber 260 and the supply member 250 in order.

The separating pad 234 includes a pad support, a spring disposed on the underside of the pad support and a separating pad provided with a large coefficient of friction that applies pressure on the driven roller 232 through the urging force of the spring. The widthwise dimension of the separating pad 234 and the driven roller 232 in the direction orthogonal to the conveying direction are shorter than the width dimension of the sheet 150. When the sheet 150 is conveyed, the separating pad 234 and the driven roller 232 contact only approximately the widthwise center of the sheet 150. The uppermost sheet among the sheet 150 stacked on the pressure plate is pressed against the driven roller 232. The rotation of the driven roller 232 causes a single sheet 150 on top of the stack to be introduced between the driven roller 232 and separating pad 234 one at a time. The single sheet 150 interposed between the driven roller 232 and the separating pad 234 in then conveyed to the deskew chamber 260 and the supply member 250 in order.

Sheets 150 supplied from either of the supply members 210, 230 are conveyed to the opposite side of the deskew chamber 260 to the supply member 250. The supply member 250 consists of a driven roller 252 backed by an opposing idler roller 254 that define a nip region 256 there between. In various other exemplary embodiments, the opposing idler roller 254 can be coupled to the driven roller 252 through a gear train. The driven roller 252 is driven by a drive mechanism, such as a drive motor operably coupled to the roll. Furthermore, suitable coupling may be through a drive belt, pulley, output shaft, gear or other conventional linkage or coupling mechanism. Sheets 150 supplied from the supply member 250 are conveyed to the transfer station D.

Located between supply members 210, 230 and supply member 250 is the common deskew chamber 260. The deskew chamber 260 is a double sided chamber formed downstream from the supply members 210, 230 and upstream from the supply member 250. As such, all three of the sheet supply paths, i.e., from the main supply, the additional feeder supply and from the multi-purpose tray, merge prior to the supply member 250 and transfer station D. Sheets 150 from the supply paths can be thus be deskewed by forming a buckle in the common deskew chamber 260 prior to being fed to the transfer station D.

As should be appreciated, with a double sided deskew chamber 260, the size of the reproduction system can be reduced. Also, manufacturing costs can be reduced because fewer parts are required in order to create a single deskew chamber 260.

As shown in FIG. 2, the deskew chamber 260 consists of a first guide member 270 with an interior first surface 272 and a second guide member 280 with an interior second surface 282 opposite the first surface 272. In this exemplary embodiment, the first guide member 270 is formed of a substantially triangular shape with an upstream nose 274 located adjacent to the supply member 250. In various other exemplary embodiments, flexible baffles are located within the deskew chamber 260. The flexible baffles guide the sheet 150 from the supply members 210, 230 to the supply member 250.

Copier 100 also includes various sensors along the paths that monitor various movements through the path, such as sensors 170, 172, and 174 as known in the art.

A description will now be given explaining how skew is removed from a sheet 150 in the deskew chamber 260. A description will first be given of a sheet 150 that is advanced from the supply member 210 to the supply member 250. Then, a description will be given of a sheet that is advanced from the supply member 230 to the supply member 250. However, as should be appreciated, the positions of the supply members 210, 230 can be reversed.

Figure 3:
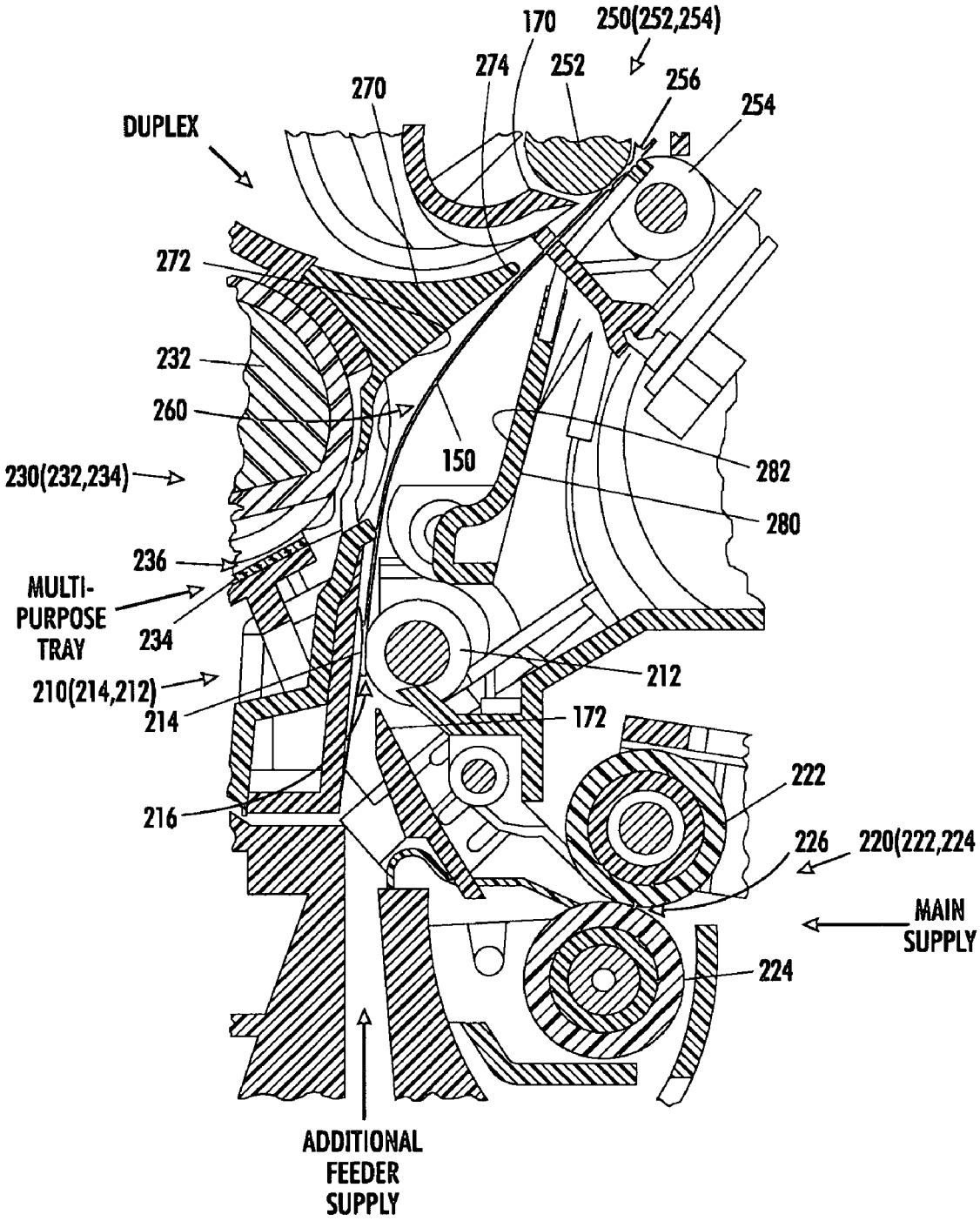
FIGS. 3–5 are cross sectional views showing in detail an exemplary deskew system using a first supply roller according to an exemplary embodiment of this invention.

When the supply member 210 advances a sheet 150, the sheet 150 is biased by the driven roller 212 toward the idler roller 214 to define a nip region 216 for advancing the sheet 150 toward the supply member 250. As shown in FIG. 3, the leading edge of the sheet 150 advances through the deskew chamber 260 in order to contact a nip region 256 formed by the stationary driven roller 252 and the idler roller 254.

Figure 4:
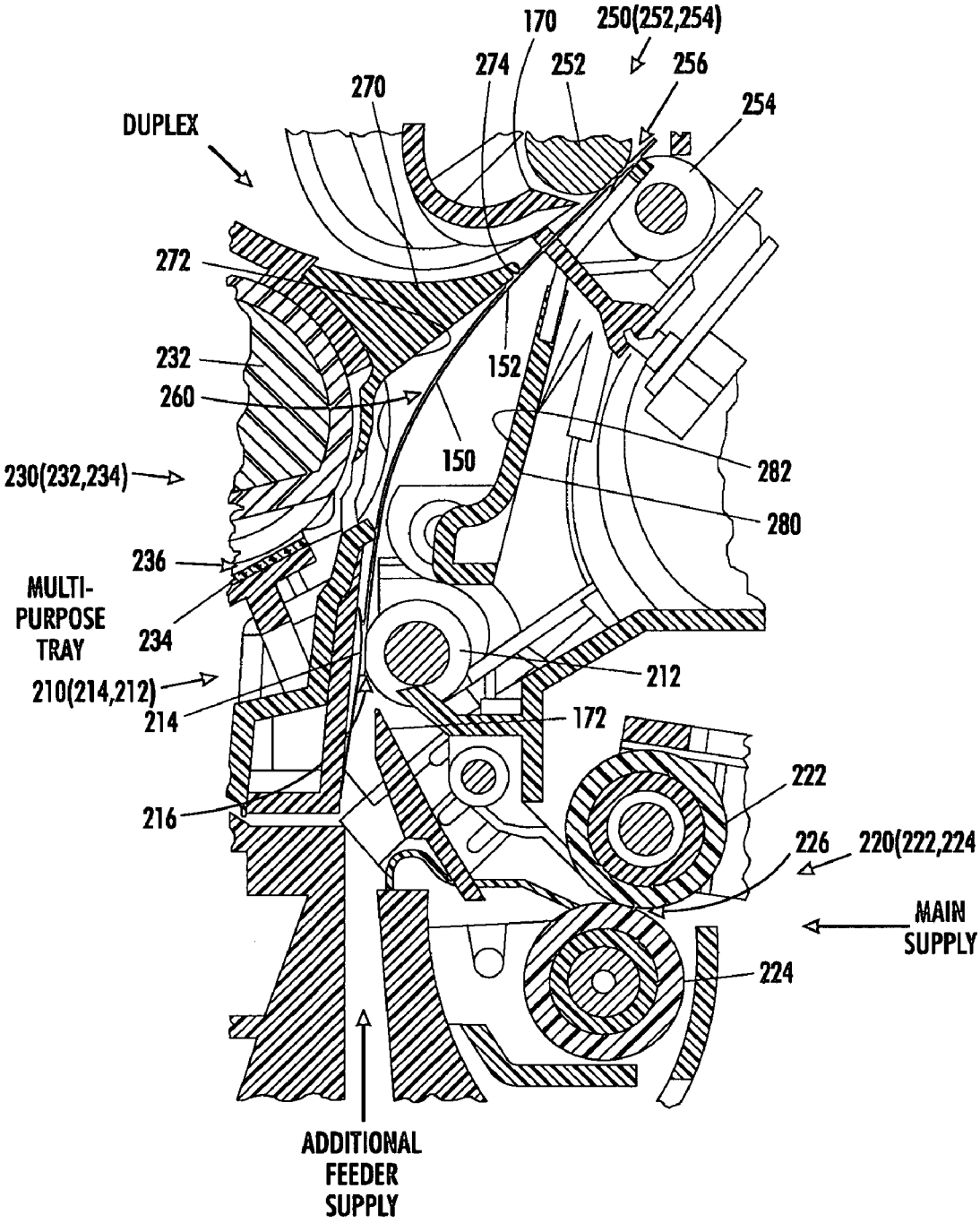

As shown in FIG. 4, the sheet 150 is then over-driven into the nip region 256 formed by the driven roller 252 and the idler roller 254 to form a buckle 152 in the sheet 150. The size of the buckle 152 is predetermined by driving the sheet 150 a fixed distance after the leading of the sheet 150 trips the sensor 170 that is positioned in the deskew chamber 260.

The sheet 150 forms a buckle 152 in the direction that the sheet 150 is advanced. As illustrated by FIG. 3, the sheet 150 travels up and to the right in the deskew chamber 260 from the supply member 210 to the supply member 250. As such, when the buckle 152 is formed as shown in FIG. 4, the sheet 150 forms a buckle 152 up and to the left toward the first surface 272 of the guide member 270. In various other exemplary embodiments, the deskew chamber 260 includes a baffle in order to provide guidance for the sheet 150 so that the sheet 150 moves up and to the right. As should be appreciated, when forming a buckle, there is a lot of relative motion between the sheet 150 and the guide member 270 close to the supply member 250. In this case, a lot of relative motion is concentrated near the exit of the buckle chamber 260 close to the nose 274.

The buckle 152 in the sheet creates a spring return force in the sheet 150 that tends to urge the leading edge into the nip region 256 formed by the driven roller 252 and the idler roller 254. The magnitude of this return spring force varies with the type, size, thickness and angular orientation of the sheet 150.

After the buckle 250 has obtained the predetermined size, the driven roller 212 of the supply member 210 is stopped, the spring return force created in the buckle 152 urges the leading edge of the sheet 150 into the nip region 256 formed by the driven roller 252 and the idler roller 254, and the driven roller 252 of the supply member 250 is driven.

The method of creating a buckle 152 in the sheet 150 to remove skew can cause damage to some sheets 150. As discussed, when the sheet 150 is advanced from the supply member 210 to a stationary supply member 250, the buckle 152 first forms at an upstream portion of the deskew chamber 260 along the nose 274 of the guide member 270. It has been discovered that when a buckle 152 first forms on the nose 274 of the guide member 270, there is a lot of relative motion between the sheet 150 and the guide member 270 close to where the sheet 150 exits the deskew chamber 260. However, there is a small amount of relative motion between the sheet 150 and the guide member 270 close to where the sheet 150 enters the deskew chamber 260. As such, damage can occur on sensitive sheets 150 by the spring return force created by the buckle 152 when the sheets 150 move against the nose 274 and then exits the deskew area. For example, scratches can appear on transparencies when the transparencies are forced against the nose 274 and move across the nose 270 in order to exit the deskew area.

To overcome this problem, it is desirable to have the sheet 150 press against a larger portion of the guide member 270 and to reverse the location in which a lot of relative motion occurs. In order to accomplish this, according an exemplary embodiment of this invention, the supply member 250 advances the sheet 150 against the supply member 210 held stationary. By reversing the method by which the buckle 152 is formed, the formation of the buckle 152 can occur at a more downstream position of the guide member 270.

When the supply member 210 advances the sheet 150, the sheet 150 is biased by the driven roller 212 toward the idler roller 214 to define a nip region 216 for advancing the sheet 150 toward the supply member 250. As shown in FIG. 3, the leading edge of the sheet 150 advances through the deskew chamber 260 in order to contact a nip region 256 formed by the driven roller 252 and the idler roller 254.

The sheet 150 is then advanced a predetermined distance past the nip region 256 as detected by the sensor 170 located upstream from the supply member 250. After the sheet 150 advances a predetermined distance past the nip region 256, the driven roller 2212 of the supply member 210 and the driven roller 252 of the supply member 250 are stopped. As such, two nip regions 216, 256 are formed by both the idler roller 214 and the driven roller 212 and the driven roller 252 and the idle roller 254.

Figure 5:
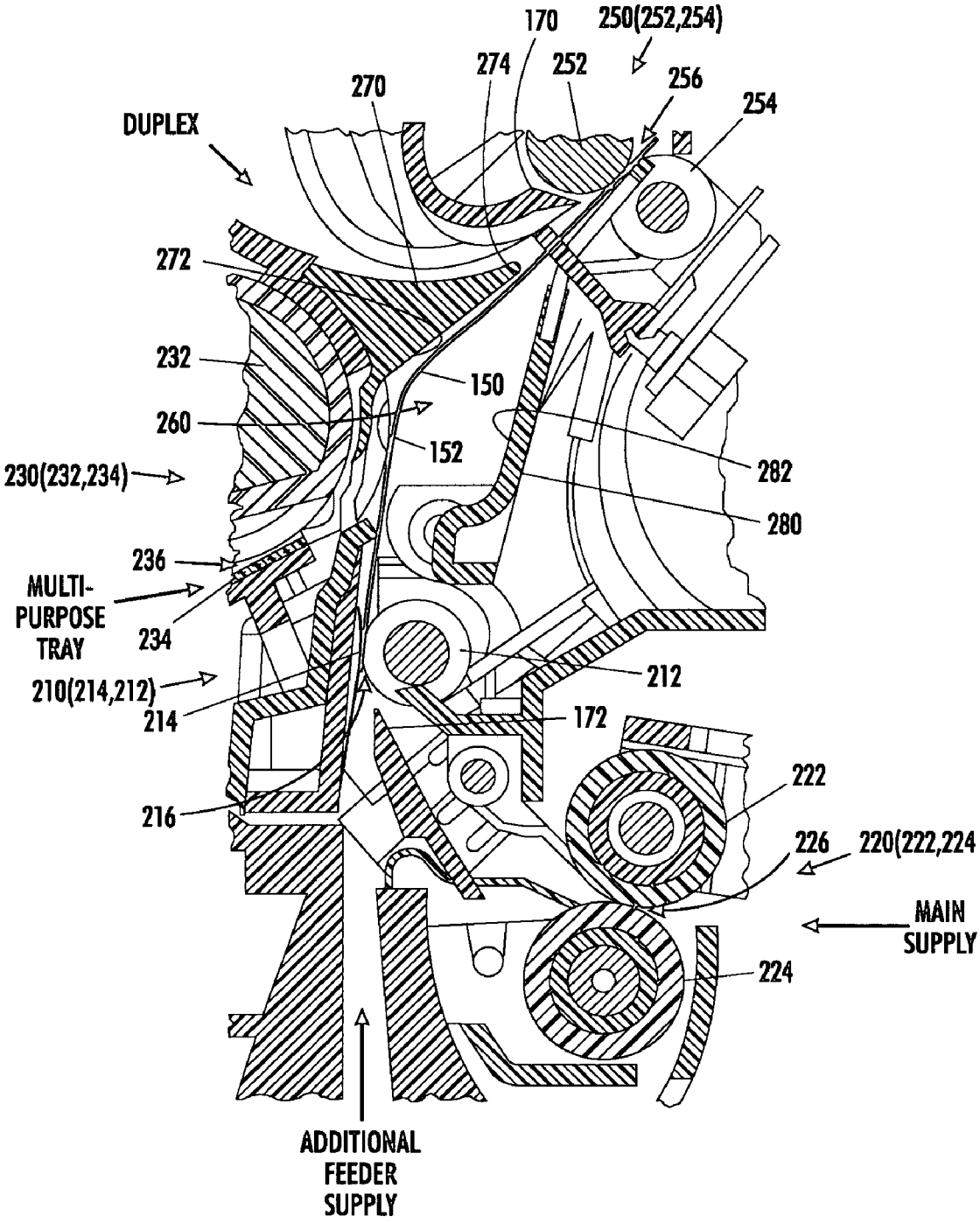

The driven roller 252 of the supply member 250 is then driven in the reverse direction in order to return the sheet toward the supply member 210. As shown in FIG. 5, the sheet 150 is over-driven into the nip region 216 formed by the driven roller 212 and the idler roller 214 to form a buckle 152 in the sheet 150. The buckle 152 has obtained its predetermined size when the sheet 150 is driven out completely out of the supply member 250. In various exemplary embodiments, the driven roller 252 remains on after the sheet 150 exits the supply member 250 in order to ensure that the leading edge of the sheet 150 is against but not in the nip region 256.

The sheet 150 forms a buckle 152 in the direction that the sheet 150 is advanced. As illustrated by FIG. 5, the sheet 150 travels down and to the left in the deskew chamber 260 from the supply member 250 to the supply member 210. As such, when the buckle 152 is formed as shown in FIG. 5, the sheet 150 forms a buckle 152 down and to the left toward the first surface 272 of the guide member 270. In various other exemplary embodiments, the deskew chamber 260 includes a baffle in order to provide guidance for the sheet 150 so that the sheet 150 moves up and to the right. The sheet 150 first forms a buckle 152 at a position close to the stationary member. As shown in FIG. 5, the stationary member is the supply member 210. The buckle 152 will thus first form at a upstream portion of the deskew chamber 260 along the guide member 270. As should be appreciated, there is a lot of relative motion between the sheet 150 and the guide 270 near the entrance of the deskew chamber 260, near the transport rollers 210 when the sheet 150 is advanced by the supply member 250 to the supply member 210. Conversely, there is a small amount of relative motion near the exit of the deskew chamber 260.

The buckle 152 in the sheet 150 creates a spring return force in the sheet 150 that tends to urge the leading edge into the nip region 216 formed by the driven roller 212 and the idler roller 214. The magnitude of this return spring force varies with the type, size, thickness and angular orientation of the sheet.

After the buckle 150 has obtained the predetermined size, the driven roller 252 of the supply member 250 is stopped and then driven in the forward direction. At the same time, 210 also starts up again. The spring return force created in the buckle 152 urges the leading edge of the sheet 150 against the nip 256 formed by the driven roller 252 and the idler roller 254. The sheet will be deskewed after it goes through nip 250 because the lead edge was straightened out against the nip as the result of the spring back force.

As discussed, when the sheet 150 is advanced by the supply member 250 to the supply member 210, the buckle 152 in the sheet creates a spring return force in the sheet 150 that tends to urge the leading edge into the nip region 216 formed by the driven roller 212 and the idler roller 234.

Figure 6:
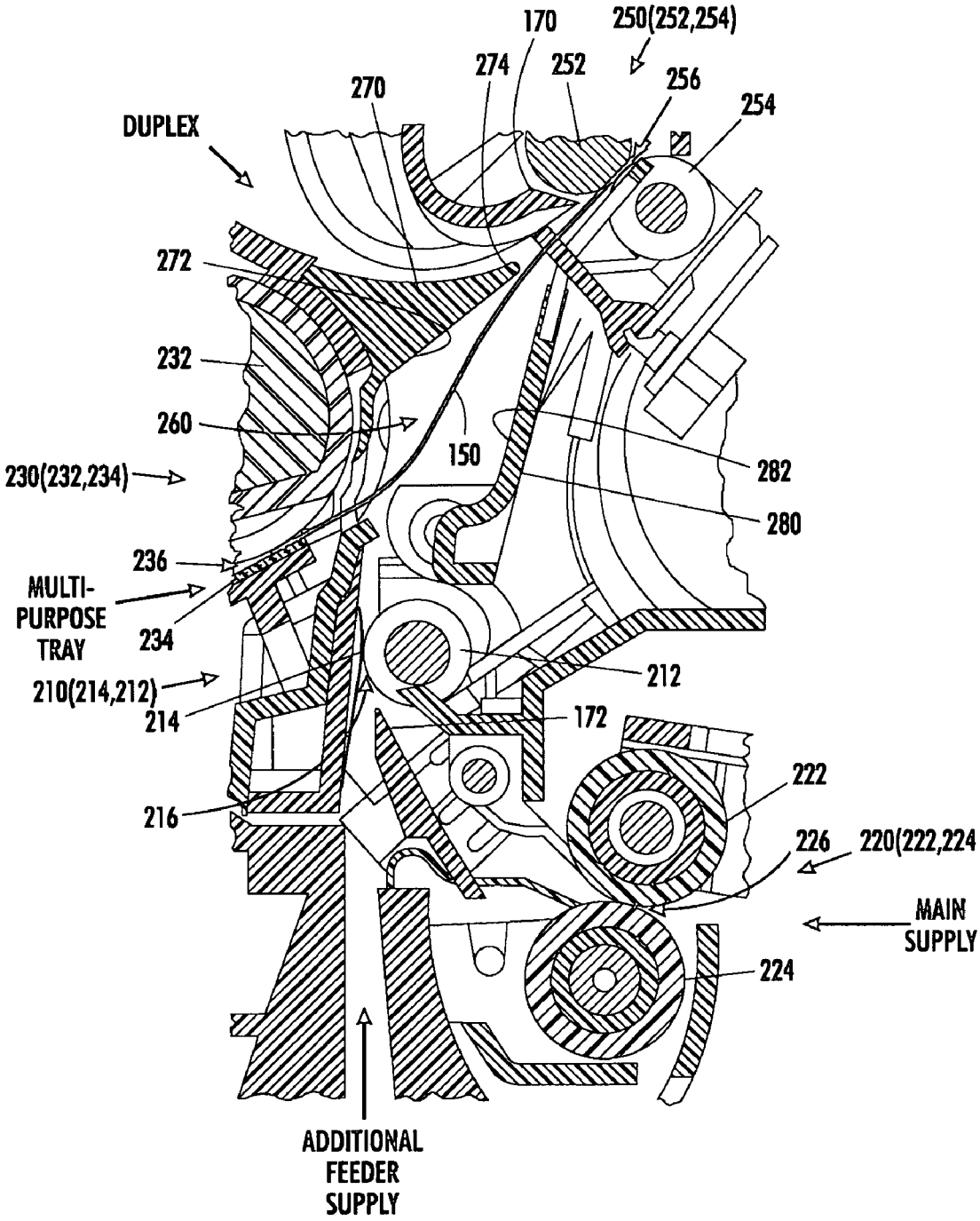
FIGS. 6–8 are cross sectional views showing in detail an exemplary deskew system using a second supply roller according to an exemplary embodiment of this invention.

When the supply member 230 advances the sheet 150, the sheet 150 is biased by the driven roller 232 toward the separating pad 234 to define a nip region 236 for advancing the sheet 150 toward the supply member 250. As shown in FIG. 6, the leading edge of the sheet 150 advances through the deskew chamber 260 in order to contact a nip region 256 formed by the stationary driven roller 252 and the idler roller 254.

The sheet 150 is then over-driven into the nip region 256 formed by the driven roller 252 and the idler roller 254 to form a buckle 152 in the sheet 150. The size of the buckle 152 is predetermined by driving the sheet 150 a fixed distance after the leading edge of the sheet 150 trips the sensor 170 that is positioned in the deskew chamber 260.

Figure 7:
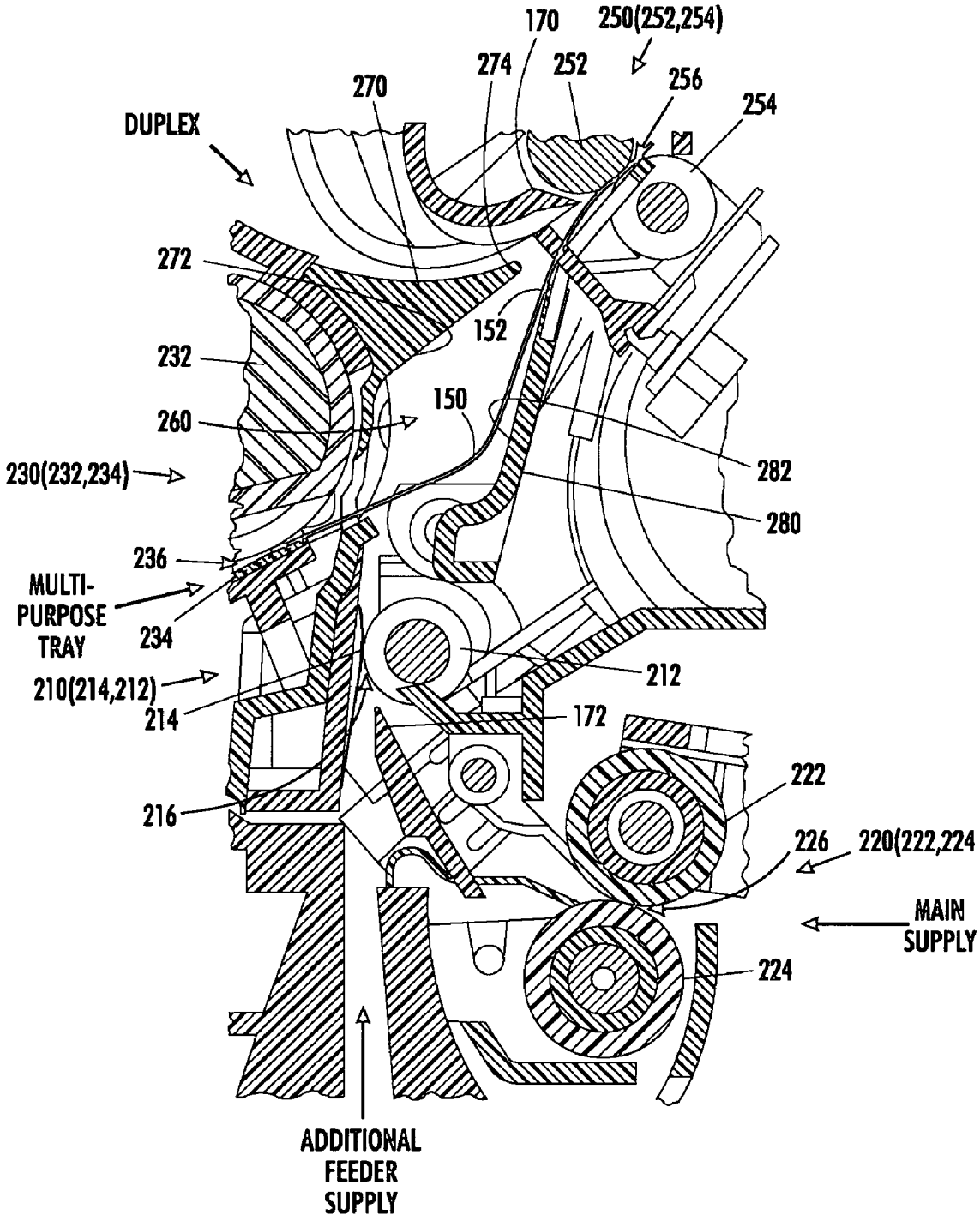

The sheet 150 forms a buckle 152 in the direction that the sheet 150 is advanced. As illustrated by FIG. 6, the sheet 150 travels right and then up in the deskew chamber 260 from the supply member 230 to the supply member 250. This is opposite to the travel sequence of the sheet 150 when the sheet 150 is advanced from the supply member 210 where the sheet 150 first moves up and then to the right. As such, when the buckle 152 is formed as shown in FIG. 7, the sheet 150 forms a buckle 152 right and up toward the second surface 282 of the guide member 280. In various other exemplary embodiments, the deskew chamber 260 includes a flexible baffle in order to provide guidance for the sheet 150 so that the sheet 150 moves right and then up. The sheet 150 also forms a buckle 152 at a position closest to a stationary member. As shown in FIG. 7, the stationary member is the supply member 250. The buckle 152 will thus first form at an upstream portion of the deskew chamber 260 along the second guide member 280.

The buckle 152 in the sheet creates a spring return force in the sheet 150 that tends to urge the leading edge into the nip region 256 formed by the driven roller 252 and the idler roller 254. The magnitude of this return spring force varies with the type, size, thickness and angular orientation of the sheet.

After the buckle 152 has obtained the predetermined size, the driven roller 252 of the supply member 250 is driven while leaving the driven roller 232 of the supply member 230. The spring return force created in the buckle 152 urges the leading edge of the sheet 150 into the nip region 256 formed by the driven roller 252 and the idler roller 254. The sheet will be deskewed because during the formation of the buckle, the lead edge straightened out against nip 250.

When creating a buckle 152 in stiffer sheets 150, the driven roller 232 may not be able to provide a sufficient driving force in order to over-drive the sheet 150 into the nip region 256 formed by the driven roller 252 and the idler roller 254 in order to form a buckle 152. Unlike the driven roller 214 of the supply member 210, the driven roller 232 must overcome a resistance force applied by the separating pad 232.

As previously discussed, the driven roller 232 and the separating pad 234 together cause a single sheet 150 on top of a stack to be introduced between the driven roller 234 and separating pad 232 one at a time. In order to provide this separation, the separating pad 234 has a large coefficient of friction. The separating pad 234 also applies a sufficient amount of force against the driven roller 232 in order to separate sheet of paper. The coefficient of friction and pressing force of the separating pad 234 together create a resistance.

Figure 9:
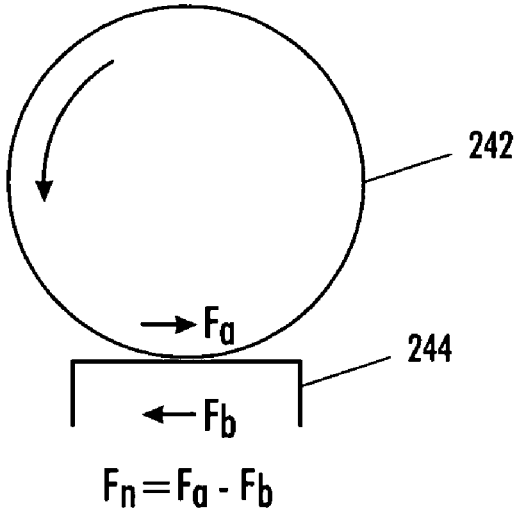
FIGS. 9 and 10 are diagrams illustrating the forces applied to a sheet according to an exemplary embodiment of this invention.

As shown in FIG. 9, in order to advance a sheet 150, the driven roller 232 must drive the sheet 150 with a greater drive force Fa toward the deskew chamber 260 than a resistance force Fb applied by the separating pad 234. In other words, the net driven force Fn, when the driven roller 232 is rotated counterclockwise as shown, is calculated by subtracting a resistance force Fb created by the separating pad 234 from a drive force Fa created by the driven roller 232.

As should be appreciated, a sufficient net drive force Fn must be applied in order to over-drive the sheet 150 into the nip region 256 in order to create the buckle 152. One solution is to add another supply member like a regular transport nip. However, manufacturing costs are increased in providing the additional supply member.

To overcome this problem, it is desirable to use the resistance force from both the driven roller 232 and the separating pad 234. In order to accomplish this, according an exemplary embodiment of the invention, the supply member 250 advances the sheet 150 against a stationary supply member 230. By reversing the method by which the buckle 152 is formed, the formation of the buckle 152 can occur by using a resistance force from both the driven roller 232 and the separating pad 234.

Figure 10:
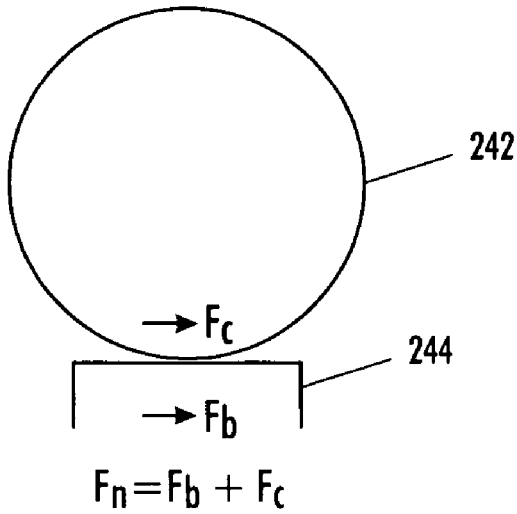

As shown in FIG. 10, when a sheet 150 is pressed against the nip region 236 formed by the stationary driven roller 232 and separating pad 232, the resistance force Fb is applied not only from the separating pad 234, but a resistance force Fc is also applied by the stationary driven roller 232 in the same direction as the resistance force Fb. A resistance force Fc of the stationary driven roller 232 is created by the driven roller 232 coefficient of friction and resistance to driving in a clockwise direction as shown in FIG. 10. In other words, the net resistance force Fr, when the driven roller 232 is stationary, is calculated by adding the resistance force Fb created by the separating pad 234 with the resistance force Fc created by the driven roller 232.

In order to accomplish this, the sheet 150 is over-driven into the supply member 230 by the supply member 250. In particular, the supply member 230 first advances the sheet 150. The sheet 150 is biased by the driven roller 232 toward the separating pad 234 to define a nip region 236 for advancing the sheet 150 toward the supply member 250. As shown in FIG. 6, the leading edge of the sheet 150 advances through the deskew chamber 260 in order to contact a nip region 256 formed by the driven roller 252 and the idler roller 254.

The sheet 150 is then advanced a predetermined distance past the nip region 256 as detected by the sensor 170. After the sheet 150 advances a predetermined distance past the nip region 256, the driven roller 232 of the supply member 230 and the driven roller 252 of the supply member 250 are stopped. As such, a nip region 236, 256 formed by both the separating pad 234 and the driven roller 232 and the driven roller 252 and the idle roller 254.

Figure 8:
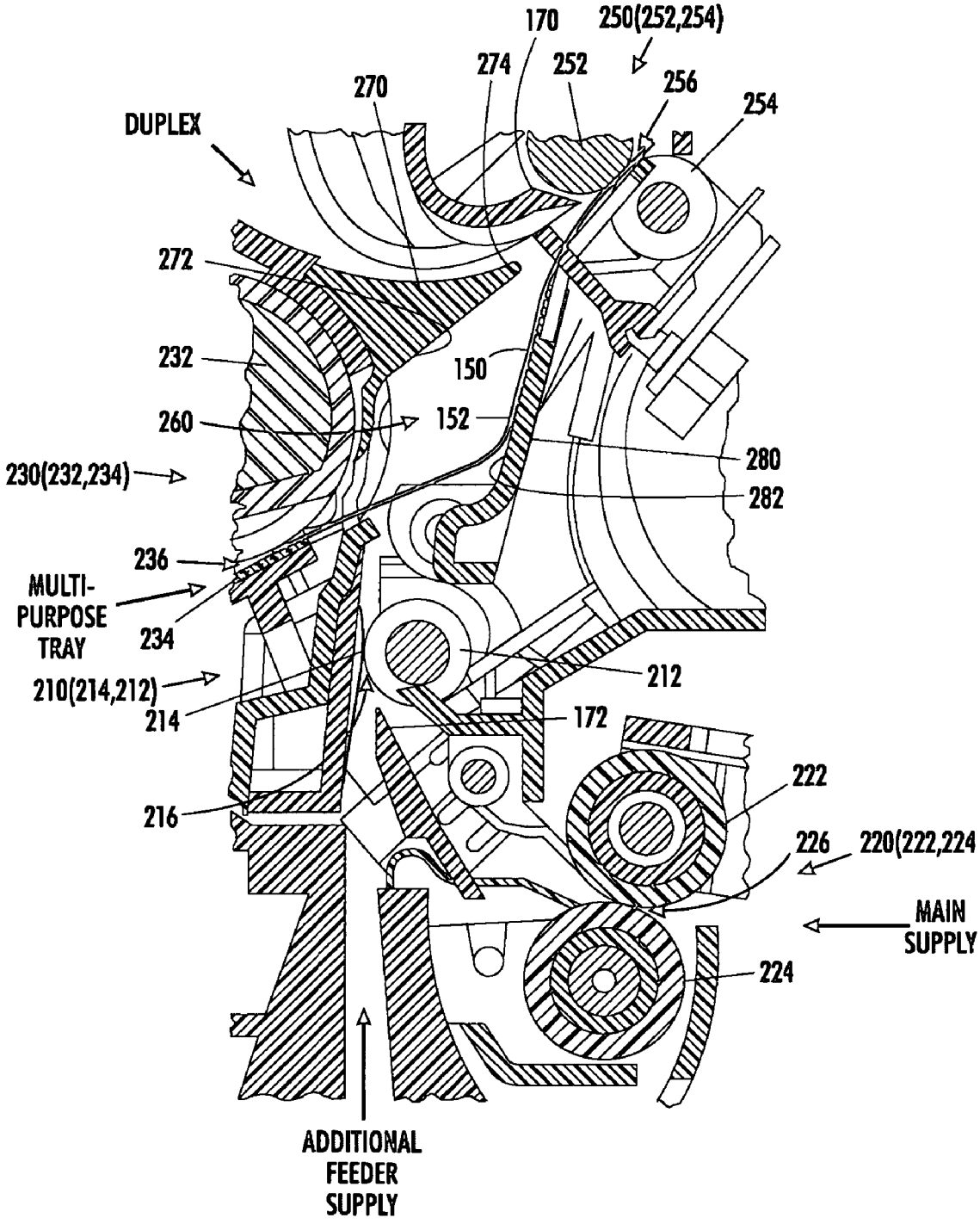

The driven roller 252 of the supply member 250 is then driven in the reverse direction in order to return the sheet 150 toward the supply member 230. As shown in FIG. 8, the sheet 150 is over-driven into the nip region 236 formed by the driven roller 232 and the separating pad 234 to form a buckle 152 in the sheet 150. The size of the buckle 152 is predetermined by driving the sheet 150 a fixed distance after the leading of the sheet 150 trips the sensor 170 that is positioned in the deskew chamber 260. Actually, we already had driven the sheet passed 170 when going forward. Now we are reversing and drive the sheet completely out of nip 250.

The sheet 150 forms a buckle 152 in the direction that the sheet 150 is advanced. As illustrated by FIG. 8, the sheet 150 travels left and down in the deskew chamber 260 from the supply member 250 to the supply member 230. As such, when the buckle 152 is formed as shown in FIG. 8, the sheet 150 forms a buckle 152 down and to the right toward the second surface 282 of the guide member 280. In various other exemplary embodiments, the deskew chamber 260 includes a baffle in order to provide guidance for the sheet 150 so that the sheet 150 moves right and the up when coming from 230. The sheet 150 also forms a buckle 152 at a position closest to a stationary member. As shown in FIG. 8, the stationary member is the supply member 230. The buckle 152 will thus first form at an upstream portion of the deskew chamber 260 along the second guide member 280.

The buckle 152 in the sheet creates a spring return force in the sheet 150 that tends to urge the leading edge into the nip region 236 formed by the driven roller 232 and the separating pad 234. The magnitude of this return spring force varies with the type, size, thickness and angular orientation of the sheet.

After the buckle 150 has obtained the predetermined size, the driven roller 252 of the supply member 250 is stopped and then reversed in the forward direction. The spring return force created in the buckle 152 urges the leading edge of the sheet 150 into the nip region 256 formed by the driven roller 252 and the idler roller 254. Again, the sheet is deskewed because the buckle forced the lead edge to straighten out against the 250 nip. After that it is simply moved forward.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A deskew system for deskewing a sheet, comprising:

a first supplying member that feeds the sheet from a first direction;

a third supplying member that receives the sheet from the first supplying member;

a chamber with the first guide member; and a controller that controls the first supplying member and the third supplying member,wherein the controller selectively:

drives both the first supplying member and the third supplying member, drives the first supplying member and stops the third supplying member such that the sheet first contacts an upstream section of the first guide member, and drives the third supplying member and stops the first supplying member such that the sheet first contacts a downstream section of the first guide member.

2. The deskew system according to claim 1, wherein the first supplying member supplies paper from two separate supply trays or paper paths.

3. The deskew system according to claim 1, further comprising:

a second supplying member that feeds the sheet to the third supplying member, wherein the controller controls the second supplying member and the third supplying member, wherein the controller selectively:

drives both the second supplying member and the third supplying member, drives the second supplying member and stops the third supplying member, and drives the third supplying member and stops the second supplying member.

4. A reproduction system comprising the deskew system according to claim 1.

5. The deskew system according to claim 3, wherein the controller:

drives the second supplying member and stops the third supplying member when a first sheet is supplied; and drives the third supplying member and stops the second supplying member when a second sheet with a higher resistance to bending than the first sheet is supplied.

6. The deskew system according to claim 3, wherein the chamber includes a second guide member opposite the first guide member, wherein when the sheet is supplied from the first supplying member to the third supplying member when the third supplying member is stopped, the sheet moves to the first guide member of the chamber and when the sheet is supplied from the second supplying member to the third supplying member when the third supplying member is stopped, the sheet moves to the second guide member of the chamber.

7. A method for deskewing a sheet with a first supplying member that feeds the sheet, a third supplying member that receives the sheet from the first supplying member and a chamber with a first guide member, comprising:

driving the first supplying member and stopping the third supplying member when deskewing the sheet such that the sheet first contacts an upstream section of the first guide member, and driving the third supplying member and stopping the first supplying member when deskewing the sheet such that the sheet first contacts a downstream section of the first guide member.

8. The method of claim 7, wherein driving the first supplying member supplies paper from two separate paper supply trays or paper paths.

9. The method of claim 7, wherein a second supplying member feeds the sheet to the third supplying member, comprising:

driving the second supplying member and stopping the third supplying member when deskewing the sheet: and driving the third supplying member and stopping the second supplying member when deskewing the sheet.

10. The method of claim 7, wherein a second supplying member feeds the sheet to the third supplying member and the chamber includes a second guide member opposite the first guide member, comprising:

supplying the sheet from the first supplying member to the third supplying member when the third supplying member is stopped in order to move the sheet to the first guide member of the chamber; and supplying the sheet from the second supplying member to the third supplying member when the third supplying member is stopped in order to move the sheet to the second guide member of the chamber.

* * * * *